US006486854B1

(12) United States Patent
Trouillet

(10) Patent No.: US 6,486,854 B1
(45) Date of Patent: Nov. 26, 2002

(54) ELECTROMAGNETIC WAVE REFLECTOR AND METHOD FOR MAKING SAME

(75) Inventor: Jacques Trouillet, Le Mee sur Seine (FR)

(73) Assignee: Societe de Transformation Industrielle, Ozoir la Ferriere (FR)

( * ) Notice: Subject to any disclaimer, the term of this patent is extended or adjusted under 35 U.S.C. 154(b) by 0 days.

(21) Appl. No.: 09/806,083

(22) PCT Filed: Dec. 10, 1999

(86) PCT No.: PCT/FR99/02450

§ 371 (c)(1),
(2), (4) Date: Mar. 22, 2001

(87) PCT Pub. No.: WO00/24086

PCT Pub. Date: Apr. 27, 2000

(30) Foreign Application Priority Data

Oct. 16, 1998 (FR) ..... 98 13007

(51) Int. Cl.[7] ..... H01Q 15/16
(52) U.S. Cl. ..... 343/912; 156/245
(58) Field of Search ..... 343/912, 840; 428/246, 253; 57/901; 29/600, 527.4; 156/245

(56) References Cited

U.S. PATENT DOCUMENTS

| | | | | |
|---|---|---|---|---|
| 4,171,563 A | | 10/1979 | Withoos | 29/600 |
| 4,647,329 A | * | 3/1987 | Oono et al. | 156/245 |
| 4,647,495 A | | 3/1987 | Kanayama et al. | 428/246 |
| 4,863,789 A | | 9/1989 | Arai | 428/253 |

FOREIGN PATENT DOCUMENTS

| | | |
|---|---|---|
| DE | 24 44 267 | 9/1974 |
| DE | 39 11 445 | 4/1989 |
| DE | 196 13 541 | 4/1996 |
| DE | 197 37 566 | 8/1997 |
| EP | 0 595 418 | 5/1994 |
| GB | 2 203 681 | 10/1988 |
| WO | WO 99/28988 | 6/1999 |

* cited by examiner

*Primary Examiner*—Don Wong
*Assistant Examiner*—James Clinger
(74) *Attorney, Agent, or Firm*—Stroock & Stroock & Lavan LLP

(57) ABSTRACT

In this antenna in an element in an electrically conductive material, the element comprises a gauze coated at least in part by a coating of thermoplastic material.

6 Claims, 3 Drawing Sheets

ELECTROMAGNETIC WAVE REFLECTOR AND METHOD FOR MAKING SAME

The present invention concerns reflectors of electromagnetic waves in element in an electrically conductive material, preferably having a convex face which defines a focal point for radio waves. These are more often antennae in the form of a spherical or parabolic dish, but they may also have any other shape which provides focussing.

A metallic antenna produced by stamping in one or more passes, a spherical dish enabling signals from a satellite to be focussed to a point, is already known. The metal surface is radio opaque to frequencies transmitted by the satellite and permits a theoretical reflection rate of 100%. Since the shape is obtained by stamping, the sheet has to undergo several surface treatments in order to prevent corrosion. These treatments, in particular the application of a primer and a paint, have to be repeated after stamping.

Antennae made of thermosetting material which require tooling designed to obtain the desired shape, in particular parabolic, are also disclosed by DE 3911445 A. A metallic frame is manually shaped in the tool. A lump of material is then introduced into the tool above the frame. The tool is locked. A firing is carried out to polymerise the inserted material. After the firing, the tool is opened and the part is extracted from the mould. Because of the moulding technology, deburring has to be carried out, followed by sanding, application of a primer then a paint coat on the two faces.

An antenna containing a metallic gauze coated in thermoplastic resin by injection moulding is described in EP-595 418. The metallic gauze is given the desired shape before moulding is carried out. To shape a metallic gauze into a parabola with great accuracy is an operation that is very difficult to achieve.

Painting technologies with powder coating do not permit a large variation in colour without incurring disproportionate manufacturing costs due to the need to clean the production tool when changing from one colour to the other.

The invention overcomes these drawbacks and enables a reflector of electromagnetic waves to be obtained, which is protected against corrosion, much easier to manufacture and which in particular allows possible use of a paint that is much easier and less expensive to implement and thus eliminates any painting operation with powder coating and the cleaning operations which this involves.

The object of the invention is a process for manufacturing a reflector of electromagnetic waves having a shape providing focussing of electromagnetic waves, in which process an electrically conductive lattice is placed in a moulding tool, thermoplastic plastic material is placed in the moulding tool and a reflector is demoulded, wherein

- the lattice placed in the moulding tool has a shape that differs from said shape providing focussing of electromagnetic waves, and
- the thermoplastic material is injected into the moulding tool under such a pressure that it forms the lattice into said shape providing focussing.

The lattice no longer has to be shaped independently of the moulding operation. This shaping is carried out by the moulding operation itself The lattice of electrically conductive material may comprise wires arranged at a distance, preferably at a constant spacing, from each other. For preference, the lattice is a gauze or a grid, in particular planar.

Manufacture is effected by injection moulding a thermoplastic material, preferably onto a grid with a uniform mesh of an electrically conductive material. Injection is carried out at high pressure, for example in excess of 50 bar and more often between 150 and 450 bar.

For preference, the process comprises

- gripping between the two mould halves of a thermoplastic material injection mould a lattice of an electrically conductive material of such a dimension that it overhangs the periphery of the die of the mould,
- injecting thermoplastic material into the die,
- demoulding an injected part from the periphery of that which overhangs the lattice, and
- cutting off the lattice level with the part.

The lattice is thus well supported during moulding and the curves of the lattice and of the coating are not off centre, everything being obtained automatically by the usual moulding operation. The coating of the wires is often virtually complete and in any case occurs over more than 80% of the transverse section of the wires.

Ferrous and non-ferrous metals, among others, as well as carbon fibre or their oxides and particularly aluminium and stainless steel, can be used as an electrically conductive material. The wire usually has a diameter of 0.005 to 0.5 mm, it being understood that the wires can also have a transverse section that is other than circular and that the values indicated above then apply to the largest dimension of the transverse section.

Polyethylene, polypropylene or other polyolefins, ABS, polycarbonate, polymethyl methacrylate, among others, as well as any other injectable thermoplastic material, can be used as thermoplastic material. The thickness of the injected plastic material is generally between 0.5 mm and 1 cm.

Advantageously, the distance between the wires is between 0.003 mm and 1.5 cm.

According to a particularly preferred embodiment, the desired colour for the antenna is imparted to it by the fact the plastic material is coloured in bulk. The antenna may also be transparent.

The object of the invention is also a reflector of electromagnetic waves comprising a lattice of an electrically conductive material coated by a coating of thermoplastic material, having a central part and a border, characterised in that in the central part the lattice appears at points on one of the faces of the coating, while it is buried in the coating on one part of the border.

Depending on the direction of injection, the lattice appears at points on one or other of the faces of the border.

In the attached drawing, provided solely by way of an example:

Figure 1:
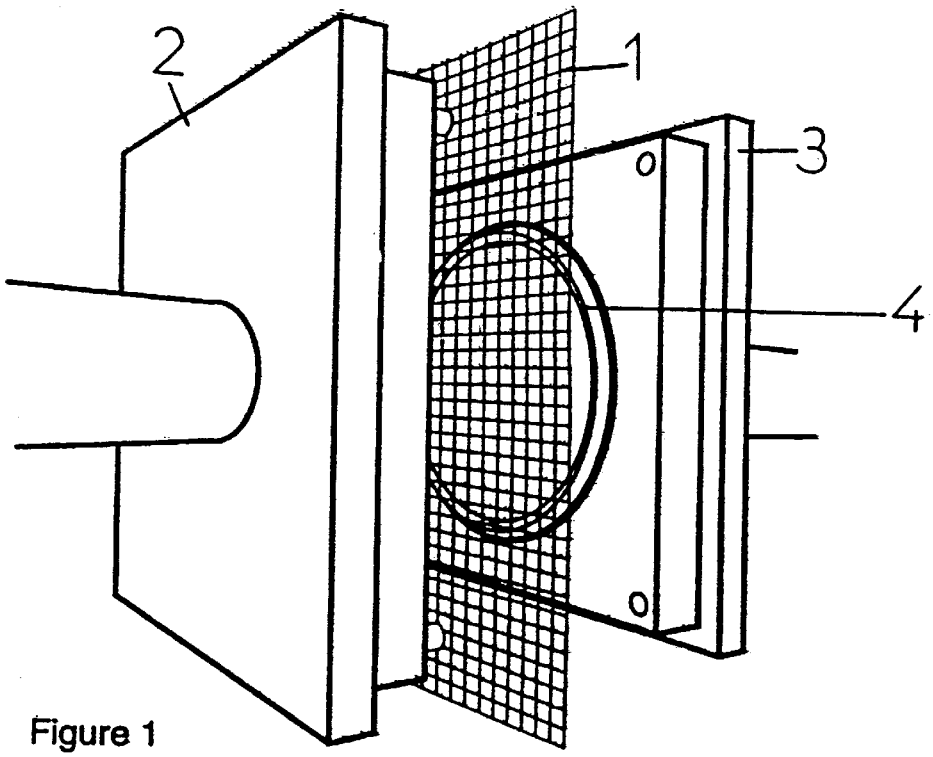
FIG. 1 is a perspective view showing two mould halves according to the invention, between which is inserted a metallic gauze.
Figure 2:
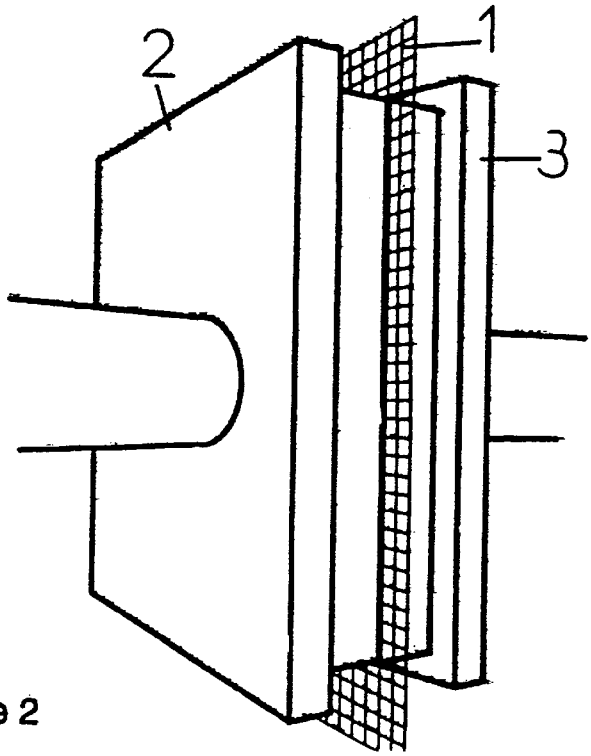
FIG. 2 shows the metallic gauze at the stage where it is gripped between the two mould halves.

A planar metallic gauze 1 is held on one of the two mould halves 2, 3 of a thermoplastic material injection mould. FIG. 2 shows that when the gauze 1 is gripped between the two mould halves 2, 3, it overhangs the periphery of the die 4 of the mould.

Figure 3:
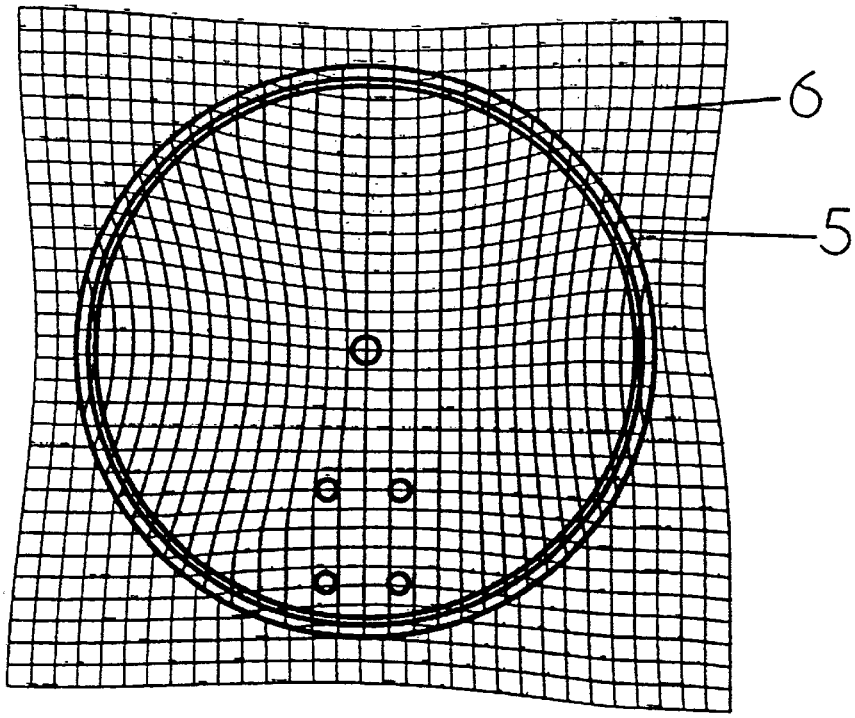
FIG. 3 is an elevation view of an antenna according to the invention before the gauze has been cut off.

FIG. 3 illustrates the demoulded injected part 5 in which the gauze 1 is encapsulated, and which extends to a part 6.

Figure 4:
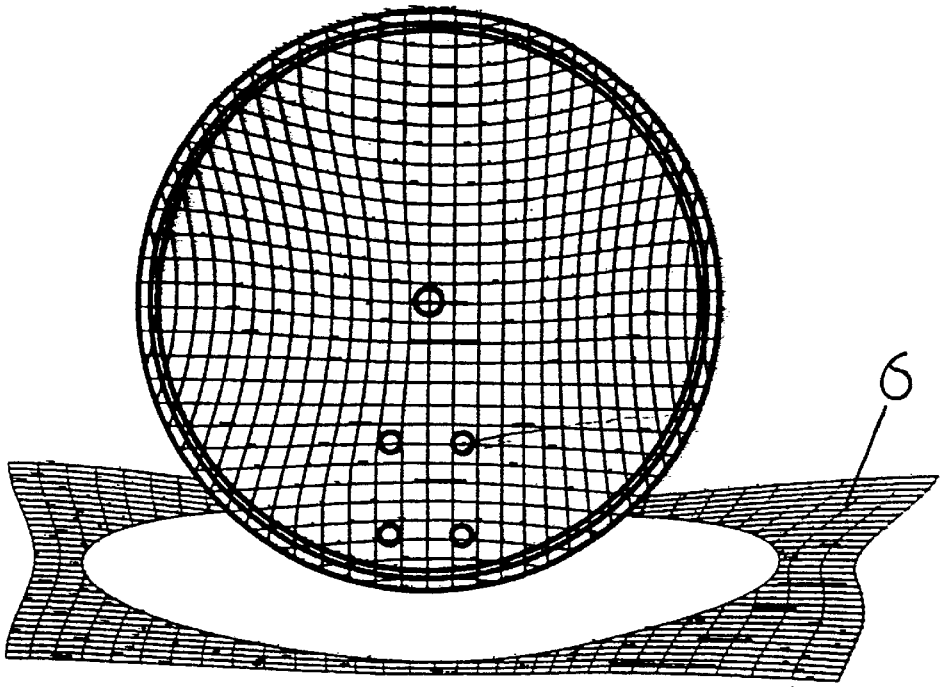
FIG. 4 shows the antenna with an offcut of the gauze which has been cut off.
Figure 5:
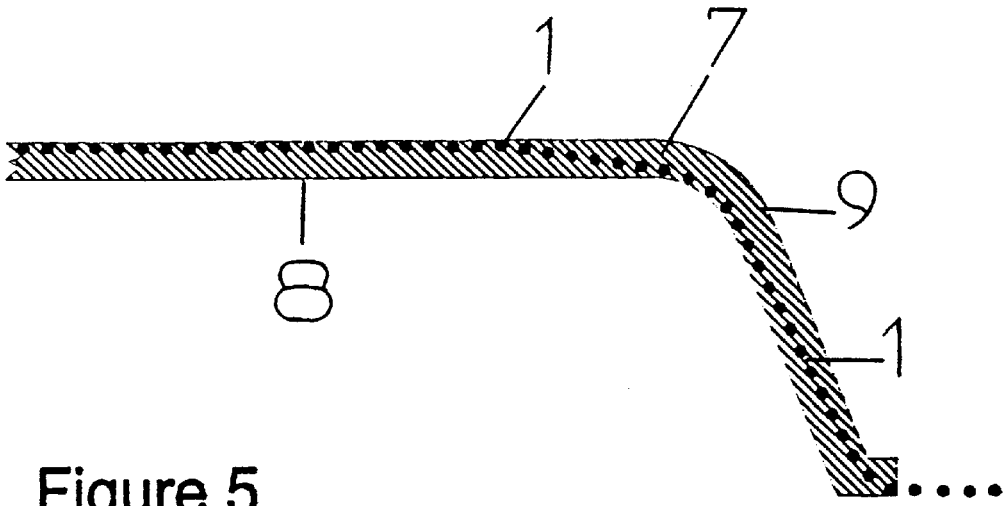
FIG. 5 is a partial sectional view of an antenna according to the invention.
Figure 6:
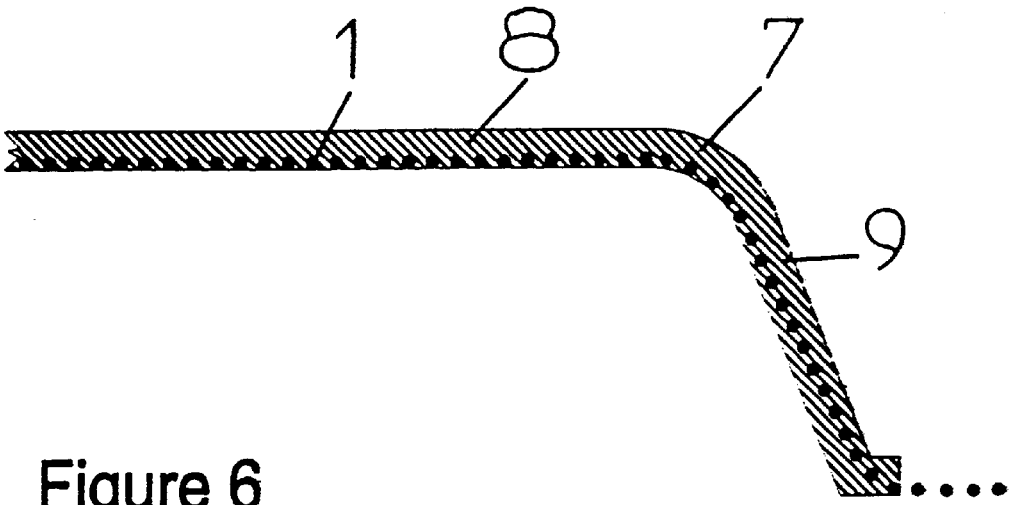
FIG. 6 is a partial sectional view of a variant of an antenna according to the invention.

FIG. 4 shows that the part 6 is cut off in the form of an offcut 6, leaving a parabolic antenna in the shape of the die 4, which antenna, as shown by FIGS. 5 and 6, consists of the gauze 1 coated by a coating 7 of thermoplastic plastics material. The antenna contains a central part 8 of parabolic shape and a peripheral border 9. In the central part 8 the gauze appears at points on one of the faces of the coating 7, while it is buried in the coating 7 on at least one part of the border 9. The antenna of FIG. 5 has been obtained when the direction of the injection current in the mould is directed vertically from bottom to top, while in FIG. 6 it was directed vertically from top to bottom.

The following example illustrates the invention.

Polyethylene previously brought to a temperature of 260° C. so that it can run through an injection point into the die 4 of the mould, which has the shape of the reflector to be produced, and into which a planar aluminium gauze is placed and which overhangs it. To fill the die a pressure of 177 bar is applied to the plastics material, the closing force of the two halves of the mould being 800 tonnes. 1.2 kg of polyethylene is injected into the die. The duration of injection is 7 seconds. The injection pressure is 117 bar. On completion of injection it is left to cool for 50 seconds, the mould is opened and the aluminium wire gauze is cut off to obtain a reflector of electromagnetic waves according to the invention.

What is claimed is:

1. A process for manufacturing a reflector of electromagnetic waves having a shape providing focussing of the electromagnetic waves, the process comprising:

placing an electrically conductive lattice in a thermoplastic material injection mould having two mould halves, wherein the lattice placed in the moulding tool is a plane metallic gauze and has a shape that differs from said shape providing focussing of the electromagnetic waves;

gripping between the two mould halves of the thermoplastic material injection mould the electrically conductive lattice, wherein the lattice is of such a dimension that a portion of the lattice overhangs the periphery of the mould;

injecting a thermoplastic material into the mould under such a pressure that the thermoplastic material forms the lattice into said shape providing focussing;

demoulding an injected part from the periphery of that which overhangs the lattice, and cutting off the lattice level with the part.

2. Process according to claim 1, wherein said shape providing focussing is a parabolic shape.

3. Process according to claim 1, wherein the injection pressure of the thermoplastic plastic material exceeds 50 bar.

4. A reflector of electromagnetic waves comprising a lattice of an electrically conductive material coated by a coating of thermoplastic plastic material and having a central part and a border, wherein the central part the lattice appears on one of the faces of the coating, while it is buried in the coating on one part of the border.

5. A reflector according to claim 4, wherein the lattice appears on one of the faces of the border.

6. Reflector according to claim 4, wherein the thermoplastic plastic material is coloured in bulk or is transparent.

* * * * *

UNITED STATES PATENT AND TRADEMARK OFFICE

CERTIFICATE OF CORRECTION

PATENT NO. : 6,486,854 B1
DATED : November 26, 2002
INVENTOR(S) : Jacques Trouillet It is certified that error appears in the above-identified patent and that said Letters Patent is hereby corrected as shown below:

Title page,
Please change: "[73] Assignee: Societe de Transformation Industrielle, Ozoir la Ferriere (FR)" to -- [73] Assignee: Société de Transformation Industrielle de Matières Plastiques-STIMAP, Ozoir la Ferriere (FR) --

Signed and Sealed this

Second Day of September, 2003

JAMES E. ROGAN
*Director of the United States Patent and Trademark Office*